US005503796A

United States Patent [19]

Sinha et al.

[11] Patent Number: 5,503,796

[45] Date of Patent: Apr. 2, 1996

[54] METHOD FOR CONFORM EXTRUSION OF POWDER FEED

[75] Inventors: Uday K. Sinha; Ronald D. Adams, both of Carroll County, Ga.

[73] Assignee: The Southwire Company, Carrollton, Ga.

[21] Appl. No.: 394,922

[22] Filed: Feb. 27, 1995

Related U.S. Application Data

[60] Continuation of Ser. No. 115,614, Sep. 3, 1993, abandoned, which is a division of Ser. No. 813,728, Dec. 27, 1991, Pat. No. 5,284,428.

[51] Int. Cl.[6] ..... B22F 3/02

[52] U.S. Cl. ..... 419/66; 419/67

[58] Field of Search ..... 419/66, 67; 72/267, 72/257; 505/823

[56] References Cited

U.S. PATENT DOCUMENTS

| | | | |
|---|---|---|---|
| 3,765,216 | 10/1973 | Green | 425/224 |
| 4,055,979 | 11/1977 | Hunter et al. | 72/262 |
| 4,101,253 | 7/1978 | Etherington | 72/262 |
| 4,138,872 | 2/1979 | Lengyel | 72/262 |
| 4,413,913 | 11/1983 | Hold et al. | 72/262 |
| 4,552,520 | 11/1985 | East et al. | 425/224 |
| 4,557,894 | 12/1985 | Bangay et al. | 72/262 |
| 4,823,586 | 4/1989 | Sinha et al. | 72/262 |
| 5,167,138 | 12/1992 | Sinha et al. | 72/262 |

OTHER PUBLICATIONS

Shi, D., et al., "Critical Currents in Silver Sheathed (Bi, Pb)$_2$Sr$_2$Cu$_3$O$_{10}$ Feed Produced by Superconducting Tapes", undated.

Shi, D., et al., "High Critical Current Density in Grain-Oriented Bulk $YBa_2Cu_3O_x$ Processed by Partial-Melt Growth," Applied Physics Letters, Jul. 1990.

*Primary Examiner*—Donald P. Walsh
*Assistant Examiner*—John N. Greaves
*Attorney, Agent, or Firm*—Wigman, Cohen, Leitner & Myers

[57] ABSTRACT

Method for continuously extruding powdered, comminuted, or particulated feed material with a Conform extrusion machine or the like in cooperation with a forming wheel rotatably disposed within a portion of the Conform wheel to compress the feed material into a compacted feedstock. Compressing of the feed material into a compacted feedstock enables uniform and reliable conveyance of the feed material into the extrusion machine without unnecessarily subjecting the compressed feedstock to air or oxygen. An auxiliary shoe member conforming to the outer periphery of the forming wheel and to the Conform shoe enables separation of the compacted feedstock from the forming wheel. The auxiliary shoe directs the compacted feedstock into a passageway formed by the Conform machine extrusion wheel and extrusion shoe. As the respective wheels are rotated the forces on the compacted feedstock heat it and cause it to yield and flow through an extrusion chamber adjacent the Conform machine abutment; it is then extruded from a die in the wall of the chamber. A temperature control system in heat exchanging relationship with the chamber in proximity to the die maintains a desired temperature uniformity in the chamber material to provide uniformity of grain size in the extruded product. Temperature control systems may also be provided for the feed material and for metallurgical control of the extruded product.

28 Claims, 2 Drawing Sheets

METHOD FOR CONFORM EXTRUSION OF POWDER FEED

This is a continuation of application Ser. No. 08/115,614 filed on Sep. 3, 1993, abandoned, which was a divisional of Ser. No. 07/813,728, filed Dec. 27, 1991, now U.S. Pat. No. 5,284,428, issued Feb. 8, 1994.

TECHNICAL FIELD

The present invention relates generally to apparatus for the extrusion of powdered metal feed materials including the extrusion apparatus generally known as "conform" machines designed to permit continuous extrusion of feedstock materials into various sizes and shapes, and, more particularly, to the extrusion of powdered metal feed materials necessary to produce so-called super-conductor extrusion products.

BACKGROUND OF THE INVENTION

Conform extrusion is a metal extrusion process in which the force for extrusion of the metal material through a die is derived, at least in part, by maintaining frictional engagement of the metal material with passageway defining surfaces of a member which is moved towards the die such that frictional drag of the passageway defining surfaces urges the metal material through the die. Apparatus for performing this method is disclosed in U.S. Pat. No. 3,765,216 ("'216") to Green and assigned to the United Kingdom Atomic Energy Authority.

The '216 patent describes an extrusion apparatus comprising a wheel member having an endless peripheral groove therein and a fixed shoe member covering at least part of the length of the groove which forms a passageway therewith. An abutment member projects from the shoe member into the groove and blocks one end of the passageway. The wheel member is rotatable relative to the shoe member in the direction towards the abutment member and at least one die orifice is associated with the abutment member.

The metal feed material to be extruded is introduced into the end of the passageway at a location remote from the abutment member and the frictional surfaces formed by the peripheral groove in the wheel carry the metal material to the abutment member. The resulting frictional forces provide a bulk compressive stress applied in the metal material to be extruded so as to feed the material into the region forward of the working face of a tool member which contains the die orifice. The bulk compressive stress forces the metal material through the die to form the conformed extrusion product.

U.S. Pat. No. 4,552,520 ("'520"), to East et al., and assigned to Metal Box Public Limited Company, discloses that a loose particulated or a comminuted form of metal material as feedstock may be supplied to produce an extrusion which closely resembles that achievable with feedstock in solid form, provided the groove includes tooth members on one or more sides of the frictional surface-forming peripheral groove which match oppositely disposed corresponding tooth members on the opposite side of the groove to remove undesirable flash. However, it has been found that particulated material, such as powdered metal, may not always flow smoothly and uniformly through the groove. The particulates have no structural integrity; regularity of flow into the Conform machine is thus permitted to become uneven. The particulated material is subjected to flow turbulence and becomes less uniform due to the mixing and shear forces across the material flow passageway to which the feed material is subjected. This is, of course, a serious problem which heretofore has limited the extrusion of powdered metal in Conform machines.

A particular problem with prior art zone melting and melt texturing production methods of certain high conductivity materials is that these processes require extremely long-term annealing periods (e.g., 150 hours) and are capable of producing products which are necessarily short in length, while normal high-speed production methods of producing conventional conductors is incapable of producing these superconductors.

The advantages of the Conform extrusion machine over conventional extrusion apparatus include the provision of a theoretically continuous extrusion process, with attendant simplification of subsequent handling techniques and the elimination of billet discards. Examples of prior art Conform extrusion apparatus of the aforementioned type are also described in U.S. Pat. No. 4,055,979 to Hunter et al.

Considerable heat is generated by the enormous frictional resistance and resulting axial stress encountered by the feedstock as it is carried along the groove by the rotating wheel, as a consequence of the close contact of the latter with the extrusion shoe. In a typical Conform extrusion process, an expansion chamber may be provided in the extrusion shoe, located adjacent the blocking abutment and upstream of the die, to allow extrusion of product having cross-sections other than that of the feed material.

The shearing forces in the feed material are higher along the extrusion shoe which is fixed relative to the moving material than along the grooved rotating wheel with which the material is moved. Thus, it may be necessary to apply differential cooling about and along the extrusion path axis. In a typical process, the extruded product may be fed into a water-quench tank located some distance from the exist die. It has been found that such prior art Conform machines produce extruded products which may be subject to undesirable characteristics.

The prior art Conform machines have been found to be limited in their ability to accommodate different feedstock materials and to produce unique propertied extrudates having special characteristics. The present invention includes the addition of a device to compress the feed materials to coalesce or agglomerate in a compacted form as the Conform feedstock. The feed materials are compacted sufficiently to cohere and maintain a generally fixed shape, thus enabling smooth and uniform flow into the extrusion passageway of the Conform machine. The feedstock materials accommodated by this compacting function include powdered and particulated materials and material mixtures having widely varying melting and solidification point temperatures.

In order to provide for compression of powdered or comminuted metal material feedstock as it enters the Conform wheel extrusion process, the present invention incorporates a plurality of peripheral wheels having metal forming surfaces which cooperate with a plurality of shoes to form the unique extrusion product. It has been found that the powder material can be compressed to about 40 percent in a preliminary step. However, this compacted material may not be completely solid and therefore may require a secondary shoe for guidance into the passageway of the Conform extrusion wheel.

More specifically, the improved apparatus includes a forming roll cooperating with both an auxiliary shoe and with a grooved Conform wheel. The feedstock is supplied at the juncture of the forming roll and the Conform wheel. The forming roll exerts compressive pressure on the powder feed material to compact it, essentially forming a preform feedstock. The first shoe, here called the secondary shoe, is positioned to direct the compacted powder material feedstock into the Conform machine.

The auxiliary shoe includes a tapered blade edge which acts as a "doctor blade" or stripper member to remove the initially compressed powder feed material from the first wheel and direct it into the second (Conform) wheel. A more conventional extrusion shoe cooperates with an abutment member in the Conform wheel peripheral groove and with an extrusion orifice upstream of the abutment, to extrude the compacted feedstock.

This improvement is particularly suitable for the extrusion of very fine particles of superconducting powders and for aluminum alloy powders. With this apparatus, certain special alloys can be produced, in the case of some materials without requiring the addition of a binder material. Examples of such compounds include yttrium, barium, and copper oxide (so-called "1-2-3 compound") which has a melting point of from about 1020° C. to about 1050° C.; bismuth (Bi), strontium (Sr), calcium (Ca), and Copper Oxide ($CuO_2$) (so-called "1112 compound"), having a melting point of from about 895° C. to about 900° C.; and silver (Ag) powder having a melting temperature of about 960.5° C.

Additionally, other yttrium-based compounds, other bismuth-based compounds, and thallium-based compounds may also be used as feed materials. A combination aluminum, vanadium, iron, and silicon alloy powder feed has been used as a feed material to produce small cross section extrudate rods. Other special alloys may be extruded from powdered or particulated materials, including high-strength rivet stock.

Powder-sintered form high-Tc superconductors can ordinarily carry only low transport critical current density (Jc) unless produced with highly textured microstructures, which are difficult to achieve, but which may be produced by zone melting and melt texturing, a process which requires an extremely long-term annealing period as described. These products are necessarily short in length. The present invention is expected to produce a highly textured microstructure high-Tc superconductor without the expensive, time-consuming zone melting, melt texturing, and long-term annealing, as in the prior art.

The method and apparatus disclosed herein provides a number of advantages in producing these and other unique extruded products. Among these advantages are the fact that the extrusion products will have a density close to the theoretical density. During extrusion, the material is known to become plastic but does not melt completely. With many of these unusual alloys, this effect tends to keep the "1-2-3 compound" in one phase; the result is improved extrudate properties.

The extrusion product grains may be aligned in the extrusion direction; this is known to produce unique properties in some materials, as was found in "Critical Currents in Silver Sheathed (Bi, Pb)$_2$Sr$_2$Cu$_3$O$_{10}$ Feed Produced by Superconducting Tapes," by Donglu Shi et al., and in "High Critical Current Density in Grain-Oriented Bulk $YBa_2Cu_3O_x$ Processed by Partial-Melt Growth," by Donglu Shi et al., Applied Physics Letters, July 1990. The resulting extrusion product will be in an annealed condition. Further in-line processing may be adapted to include wire drawing, oxygen or other annealing, and other downstream processing steps.

BRIEF DESCRIPTION OF THE DRAWING FIGURES

The above and other objects, features, and advantages of the present invention will become apparent from a consideration of the following detailed description of a preferred embodiment thereof taken in conjunction with the accompanying drawings in which.

DESCRIPTION OF THE PREFERRED EMBODIMENT

Figure 1:
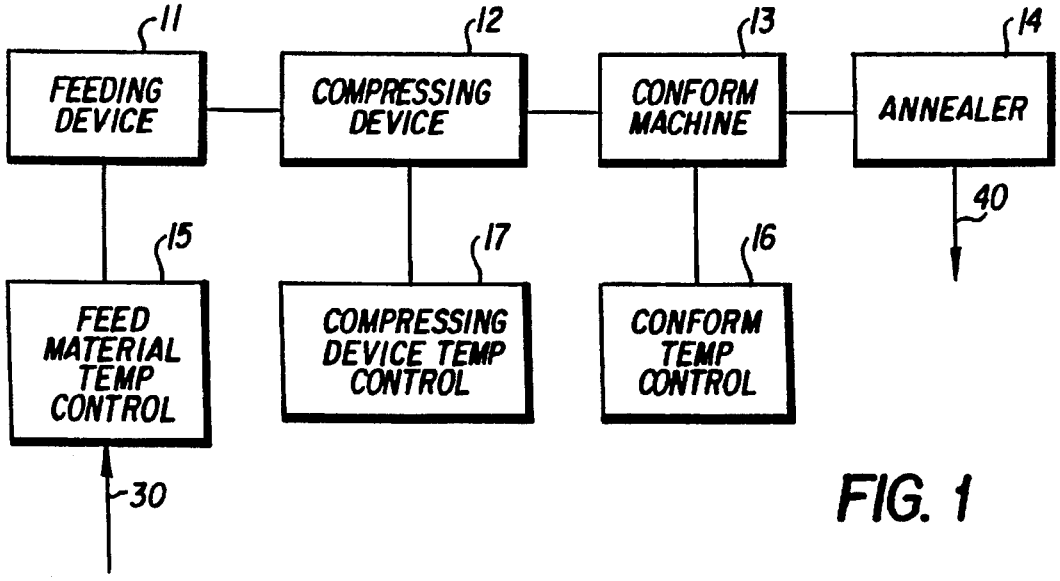
FIG. 1 is a simplified block diagram illustrating the basic apparatus according to a preferred embodiment of the invention.

There is shown in FIG. 1 a simplified block diagram illustrating cooperation of the main elements of the present invention for continuously extruding powdered or particulated feed material 30 into a desired Conform product 40. The particulated feed material 30 is supplied to a compressing device 12 via a feeding device 11. The feeding device 11 directs the feed material 30 into the compressing device 12. With certain materials having critical temperature processing requirements, it is desirable to control the temperature of the feed material 30. A temperature control device 15 is provided for the purpose of heating and/or cooling the feed material 30. With a mixture including a plurality of different feed materials, separate feed devices each having its own temperature control may be required or useful in maintaining critical feed material input temperatures.

Compressing device 12 compacts the feed material 30 into an agglomerated or coalesced coherent feedstock mass 44 (FIG. 3), suitable for conveying into the Conform machine 13. This compacted, coherent mass is moved uniformly and smoothly into the entry passage 35 of the Conform machine 13, minimizing or eliminating non-uniform, disturbed flow of the feedstock 44 entering the extrusion portion of the apparatus.

The feed material 30 is compressed by at least 20 percent to less than about 80 percent of its initial volume, generally by about 40 percent to less than about 60 percent of its initial volume, and preferably by at least 50 percent to less than about 50 percent of its initial volume. Compressing the feed material 30 to a compact, coherent mass 44 by about 60 percent to about 40 percent of its original volume may be preferred with some materials. It is believed important that the feed material 30 be compacted sufficiently for the materials to adhere to one another to form the compacted feedstock 40. Certain feed materials 30 may also require temperature control during the compressing operation. A temperature control system 17 is provided for this purpose when required. Applicants prefer compressing the feed material with a forming roll 31 rotatably positioned in a portion of the Conform machine groove 22. The forming roll 31 is heated or cooled, as necessary, in any of the known ways.

Conform machine 13 is constructed in accordance with U.S. Pat. No. 3,765,316 to Green, previously described. The Conform machine 13 may be modified to provide an expansion chamber 36 (FIG. 2) including an effective temperature control 16. Such an expansion chamber 36 and temperature control system 16 is disclosed in U.S. Pat. No. 5,167,138 to Sinha et al., assigned to the assignee of the present invention. The teaching of U.S. Pat. No. 5,167,138 is incorporated herein.

While the Conform extrudate 40 emerging from the Conform machine 13 is usually at least partially annealed, further annealing of the extrudate may be required with some materials. An annealer 14 is provided for these instances. Annealers are well known in the wire manufacturing arts.

Figure 2:
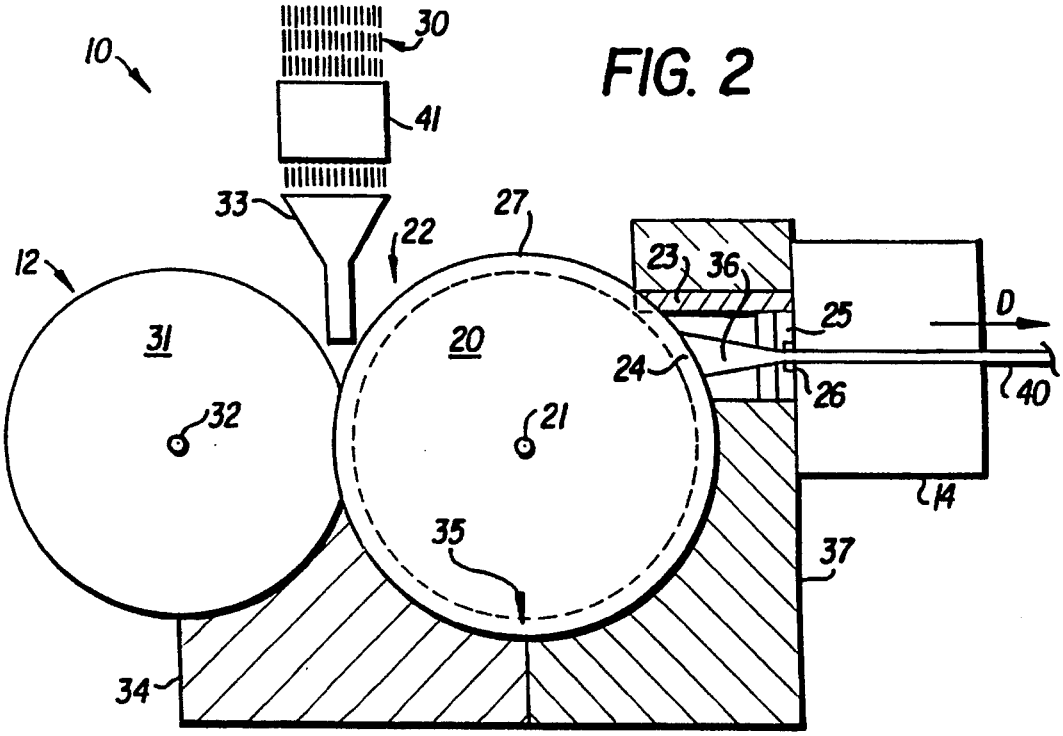
FIG. 2 is a schematic side elevation according to a preferred embodiment of the invention.
Figure 3:
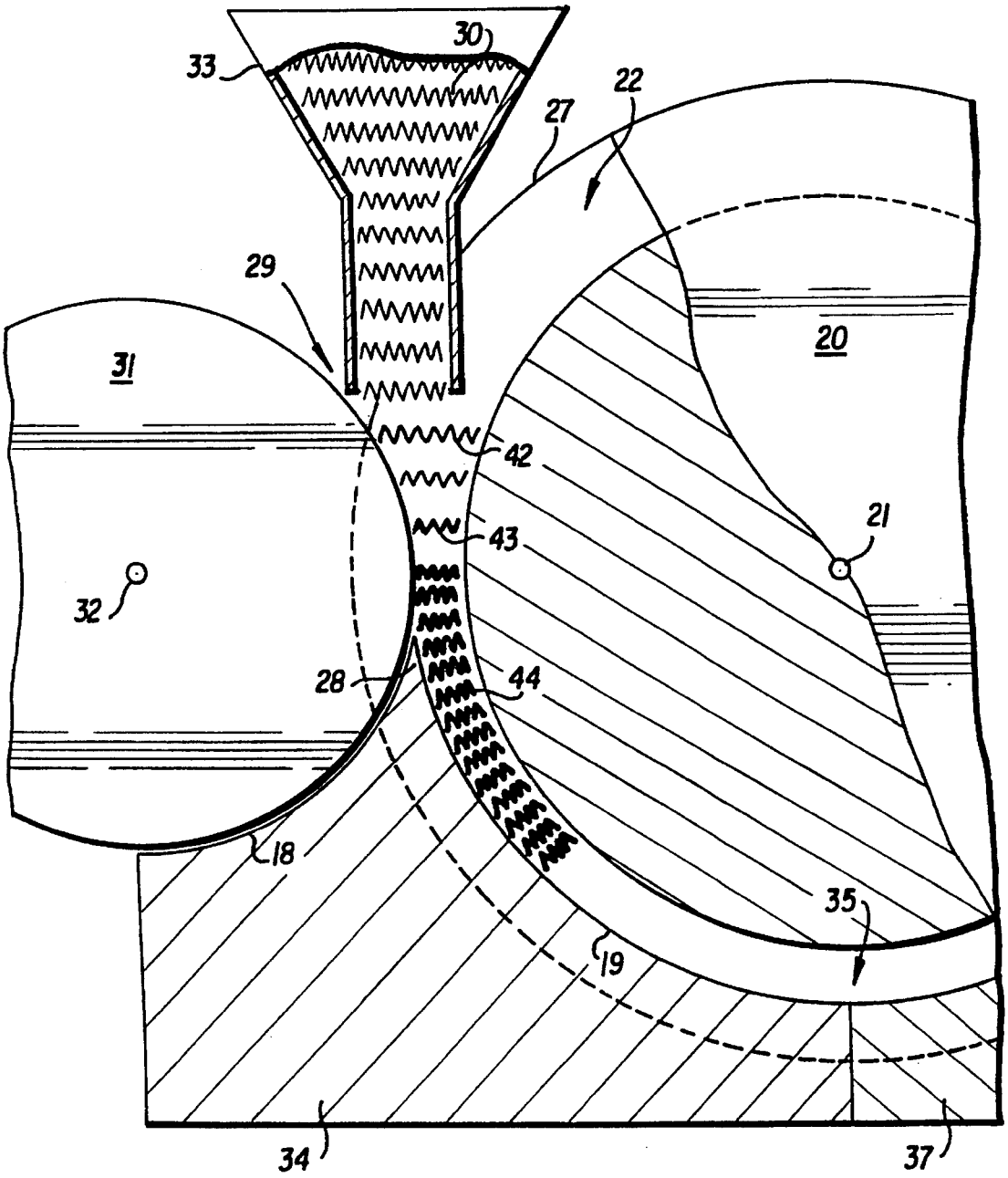
FIG. 3 is a partial cutaway side elevation view of the compressing operation.

FIGS. 2 and 3 illustrate the invention 10 schematically in greater mechanical detail, showing an elevation view with a detailed cross section view of portions of the apparatus. Referring now to FIGS. 2 and 3, an apparatus 10 for continuously extruding powdered or particulated feed material 30 into a desired Conform product 40 includes a wheel 20 mounted for rotation on a shaft 21. Wheel 20 has an endless channel or groove 22 formed in its periphery 27. The wheel 20 rotates, counterclockwise in this view, in close proximity to an extrusion shoe 37 which remains stationary relative to the wheel 20. Shoe 37 encloses a portion of the wheel 20; the portion may vary among Conform machines, but is usually approximately 90°. The channel 22 of wheel 20 and the shoe 37 thus form a passageway 35. A channel blocking abutment 23 is affixed to shoe 37 and enters the channel 22 in close proximity to the walls thereof, so that the wheel is free to rotate but a barrier is formed by abutment 23 to anything that may be carried in the passageway. The extrusion shoe 37 includes an extrusion chamber 24 disposed adjacent to the blocking abutment 23. A die block 25 at the end of the extrusion chamber forms a wall of the chamber and retains a die 26 therein to permit feed material to be extruded therethrough into the desired shape. While a round product is often easier to extrude, desired extrudate shapes also include rectilinear and other curvilinear cross sections, thus the die aperture is to be formed to the desired shape.

Thus far, the structure described is substantially conventional and known in Conform extrusion machines of the prior art. Such conventional structure is shown and described in U.S. Pat. No. 3,765,216 to Green, previously described, the teaching of which is hereby incorporated by reference.

It may be advantageous to cool the extrusion apparatus 13, especially the extrusion chamber 24 and the expansion chamber 36, if used. Such cooling is shown in U.S. Pat. No. 5,167,138 previously described. An expansion chamber 36 which ordinarily may be used to accommodate feedstock of smaller cross section than the extrusion die 26, may be used effectively with feedstocks 44 compacted of powdered or particulate feed material 30. A rounded and tapered conical longitudinal section shape is preferred for the expansion chamber 36, in order to reduce dead zones and accompanying temperature irregularities associated with larger or rectilinear chamber sections.

On the Conform machine 13 side opposite the channel blocking abutment 23 lies a forming roll 31 mounted for clockwise rotation on a shaft 32, thereby forming a device 12 for compressing the feed material 30. The width of forming roll 31 is selected such that it substantially fills channel 22 in wheel 20.

The shafts 21 and 32 form axes upon which the respective wheels 20 and 31 rotate; the shafts 21, 32 are spaced such that forming roll 31 is maintained with its outer surface passing within channel 22 at a fixed distance from the bottom of channel 22 in wheel 20.

The apparatus 10 includes an auxiliary shoe 34, seen more clearly in FIG. 3. It is shaped to closely conform with the periphery of forming roll 31 and to lie inside the periphery of wheel 20 and intrude at least partly into channel 22. Thus, auxiliary shoe 34 encloses a portion of wheel 20 and thereby extends passageway 35; auxiliary shoe 34 also closely encloses a portion of forming roll 31. That portion of auxiliary shoe 34 adjoining extrusion shoe 37 is shaped to provide a smooth transition between the auxiliary shoe 34 and extrusion shoe 37. Note that as the compacted feedstock 44 passes the closest approach of wheels 20 and 31, a pointed "doctor blade" 28 of the auxiliary shoe 34 separates the feedstock from the forming roll 31 and then auxiliary shoe surface 19 directs the compacted feedstock 44 into the Conform machine 13. Essentially, auxiliary shoe surface 19 and wheel 20 form an extension of the passageway 35 formed by shoe 37 and wheel 20. Auxiliary shoe surface 18 closely adjoins the forming roll to prevent any accumulation of feed material 30 or feedstock 44 thereon. The auxiliary shoe surface 19 and extrusion shoe 37 may extend partly into the channel or groove 22 to prevent re-expansion of the feedstock 44 after being compressed into its compact form.

Suitable mechanisms for directing the particulated or comminuted feed material 30 include a funnel 33 or the like. When a solid or encased particulated material feed is used, a guide in the general shape of funnel 33 may be used to guide the feed.

Forming roll 31 is thus positioned to compress the particulated or comminuted feed material 30 into a compacted and coherent feedstock 44 for the Conform machine 13.

When certain materials are used as the feed material 30, it is preferred that the exposure of the compacted feedstock 44 to air or oxygen is avoided. For this reason, auxiliary shoe 34 closely encloses the wheels 20 and 31 to minimize such exposure as the compacted feedstock 44 passes from the compressing area to the extrusion area along passageway 35.

Referring now to FIG. 3, the feed material 30 is fed into the channel 22; it is initially directed into the feed aperture 29, a throat formed by the forming roll 31 and groove 22 of wheel 20. This throat is of decreasing cross section, thus compressing the feed material 30 by stages at 42, 43 until compacted to the desired degree to provide a feedstock 44 to the Conform machine 13. It has been experimentally determined that compressing of the material at least 20 percent and preferably to about 30 to about 50 percent of its original volume is useful, and compressing to about 40 percent is preferred with some feed materials 30. The compacted feedstock 44 is subjected to a forward drag due to rotation of the Conform wheel 20; it fills and moves along the passageway 35.

The temperature of the particulated feed material 30 may be adjusted, as by preheater 15 (FIG. 2) or otherwise to vary the feed material 30 temperature. In some instances it may be preferred to adjust the feed material 30 temperature without preheating or precooling; this may be accomplished by heating or cooling the forming roll as known to those of skill in the metallurgical and forming arts.

Partial annealing is inherent in the Conform extrudate 40 as it exits the die 26; additional annealing may be performed with conventional annealing or other heat treating apparatus 14.

The extruded product 40 of the disclosed apparatus also benefits from the Conform process in other meaningful ways. For example, the metallurgical grains become aligned in the extrusion direction, D, which is the longitudinal dimension of the product. Longitudinally aligned metallurgical grains result in a higher current density in the longitudinal direction. This texturing has been found to develop to a greater degree in the bismuth-based and other superconducting materials, due to mechanical deformation and annealing, Although certain preferred embodiments have been described herein, it will be apparent to those of ordinary skill in the field to which the invention pertains that variations and modifications of the described embodiments may be made without departing from the spirit and scope of the invention. Accordingly, it is intended that the invention be limited only to the extent required by the appended claims.

What is claimed is:

1. A method of producing an extruded product from a particulated material in an extrusion apparatus having movable passageway defining surfaces which cooperate with a stationary shoe to form a closed passageway through which the particulated material is frictionally forced to an extrusion die, comprising the steps of:

a) feeding a particulated feed material of given density into said apparatus;

b) substantially compressing said particulated feed material prior to its conveyance into said passageway to cause it to coalesce into a dense extrusion feedstock;

c) forcing said compacted feedstock into said closed passageway; and d) extruding said compacted feedstock at high speed through said die to form an essentially continuous product;

wherein the passageway is terminated at an entrance to an extrusion chamber having an outlet through said die, further including the step of limiting re-expansion of the feedstock as it passes through the passageway after compression in step b) and before reaching the extrusion chamber.

2. The method of producing an extruded product as in claim 1, further including the step of controlling cooling of the temperature of the particulated feed material.

3. The method of producing an extruded product as in claim 1, further including the step of controlling cooling of the temperature of the compacted feedstock.

4. The method of producing an extruded product as in claim 1, wherein said particulated material is compressed by more than about 40 percent to less than about 60% of its original volume in the compression step.

5. The method of producing an extruded product as in claim 1, wherein said particulated material is compressed by more than about 50 percent to less than about 50% of its original volume in the compression step.

6. The method of producing an extruded product as in claim 1, wherein said particulated material is compressed by about 60 percent to less than about 40% of its original volume in the compression step.

7. A method of producing an extruded product from a particulated material in an extrusion apparatus having movable passageway defining surfaces which cooperate with a stationary shoe to form a passageway through which the particulated material is frictionally forced to an extrusion die, comprising the steps of:

a) feeding a particulated feed material into said apparatus;

b) substantially compressing said particulated feed material by a means for compression prior to its conveyance into said passageway to cause it to coalesce into a dense extrusion feedstock;

c) passing said feedstock from said means for compression to a means for extrusion via said passageway such that exposure to oxygen is minimized; and d) extruding said feedstock through said die to form an essentially continuous product;

wherein the passageway is terminated at an entrance to an extrusion chamber having an outlet through said die, further including the step of limiting re-expansion of the feedstock as it passes through the passageway after compression in step b) and before reaching the extrusion chamber.

8. The method of producing an extruded product as in claim 1, wherein said movable passageway defining surfaces are the walls of a groove formed in the periphery of a rotatable wheel and said compressing means is a roll mounted for rotation adjacent said wheel and having its periphery extending into said groove, wherein step b) further includes the step of compressing said particulated material by rotation of said rotatable wheel and said roll.

9. The method of producing an extruded product as in claim 1, wherein said compressing means in step b) compresses the feed material until it coalesces sufficiently to form a compacted extrusion feedstock.

10. The method of producing an extruded product as in claim 1, wherein said particulated feed material is a yttrium-based compound.

11. The method of producing an extruded product as in claim 1, wherein said particulated feed material is a bismuth-based compound.

12. The method of producing an extruded product as in claim 1, wherein said feed material is enclosed in a silver-alloy.

13. The method of producing an extruded product as in claim 1, wherein said extrusion means includes an auxiliary shoe mounted adjacent said wheel and means for stripping the compacted extrusion feedstock off of said roll and guiding it into said passageway, wherein step c) further includes the steps of separating the compacted extrusion feedstock from said roll and guiding it into said passageway.

14. The method of producing an extruded product as in claim 7, further including the step of controlling the cooling of the temperature of the particulated feed material.

15. The method of producing an extruded product as in claim 7, further including the step of controlling the cooling of the temperature of the feedstock.

16. The method of producing an extruded product as in claim 7, wherein said particulated material is compressed by more than about 40 percent to less than about 60% of its original volume in the compression step.

17. The method of producing an extruded product as in claim 7, wherein said particulated material is compressed by about 60 percent to less than about 50% of its original volume in the compression step.

18. The method of producing an extruded product as in claim 7, wherein said movable passageway defining surfaces are the walls of a groove formed in the periphery of a rotatable wheel and said compressing means is a roll mounted for rotation adjacent said wheel and having its periphery extending into said groove, wherein step b) further includes the step of compressing said particulated material by rotation of said rotatable wheel and said roll.

19. The method of producing an extruded product as in claim 7, wherein said compressing means in step b) compresses the feed material until it coalesces sufficiently to form a compacted extrusion feedstock.

20. The method of producing an extruded product as in claim 7, wherein said extrusion means includes an auxiliary shoe mounted adjacent said wheel and means for stripping the compacted extrusion feedstock off of said roll and guiding it into said passageway, wherein step c) further includes the steps of separating the compacted extrusion feedstock from said roll and guiding it into said passageway.

21. A method of producing a continuous elongated extruded product from a particulated material in an extrusion apparatus having movable passageway defining surfaces which cooperate with a stationary shoe to form a closed passageway through which the particulated material is frictionally forced to an extrusion die, comprising the steps of:

a) feeding a particulated feed material of given density into said apparatus, further including the step of controlling cooling of the temperature of the particulated feed material;

b) substantially compressing said particulated feed material prior to its conveyance into said passageway to cause it to coalesce into a dense extrusion feedstock;

c) forcing said compacted feedstock into said closed passageway; and d) extruding said compacted feedstock through said die to form an essentially continuous product, further including the step of controlling cooling of the temperature of the feedstock passing through the extrusion apparatus, wherein said compacted feedstock is conveyed directly from the compression step into the passageway and forced through the extrusion die without significant exposure to oxygen.

22. The method of claim 21, wherein the passageway is terminated at an entrance to an extrusion chamber having an outlet through said die, further including the step of limiting re-expansion of the feedstock as it passes through the passageway after compression in step b) and before reaching the extrusion chamber.

23. The method of producing an extruded product as in claim 1, further including the step of continuously extruding said compacted feedstock at through said die at a rate of from about 50 to about 100 feet per minute.

24. The method of producing an extruded product as in claim 21, further including the step of continuously extruding said compacted feedstock at high speed through said die at a rate of from about 50 to about 100 feet per minute.

25. The method of claim 7, further including the step of limiting re-expansion of the feedstock after compression in step b).

26. The method of producing an extruded product as in claim 1, wherein the step of limiting re-exansion of the feedstock extends from a point adjacent the compression through substantially all of the passageway.

27. The method of producing an extruded product as in claim 7, wherein the step of limiting re-exansion of the feedstock extends from a point adjacent the compression through substantially all of the passageway.

28. The method of producing an extruded product as in claim 22, wherein the step of limiting re-exansion of the feedstock extends from a point adjacent the compression through substantially all of the passageway.

* * * * *